US009518418B2

(12) United States Patent
Cappellotto

(10) Patent No.: US 9,518,418 B2
(45) Date of Patent: Dec. 13, 2016

(54) ASSEMBLY FOR OPENING/CLOSING OF WINGS THROUGH SYNCHRONIZED MOTION

(71) Applicant: Grass GmbH & Co. KG, Reinheim (DE)

(72) Inventor: Leandro Cappellotto, Pordenone (IT)

(73) Assignee: Grass GmbH & Co. KG, Reinheim (DE)

( * ) Notice: Subject to any disclaimer, the term of this patent is extended or adjusted under 35 U.S.C. 154(b) by 21 days.

(21) Appl. No.: 14/615,716

(22) Filed: Feb. 6, 2015

(65) Prior Publication Data

US 2015/0218873 A1 Aug. 6, 2015

Related U.S. Application Data

(63) Continuation of application No. PCT/IB2013/056405, filed on Aug. 5, 2013.

(30) Foreign Application Priority Data

Aug. 9, 2012 (IT) ..... PN2012A0046

(51) Int. Cl.
*E05F 17/00* (2006.01)
*E06B 3/50* (2006.01)
(Continued)

(52) U.S. Cl.
CPC ..... *E05F 17/00* (2013.01); *E05D 13/145* (2013.01); *E05D 15/44* (2013.01); *E05F 1/02* (2013.01);
(Continued)

(58) Field of Classification Search
CPC ..... E05F 1/02; E05F 7/08; E05F 17/00; E05F 17/004; E05F 15/665; E05F 15/686; E06B 3/44; E06B 3/5009; E06B 3/5045; E05D 13/145; E05D 15/44
(Continued)

(56) References Cited

U.S. PATENT DOCUMENTS 1,382,933 A 6/1921 Rush
2,886,394 A * 5/1959 Snyder ..... E06B 3/482 126/340
(Continued)

FOREIGN PATENT DOCUMENTS

DE 201 21 033 U1 3/2002
GB 1 257 999 A 12/1971

OTHER PUBLICATIONS

Italian Search Report and Written Opinion (Application No. ITPN20120046) dated Mar. 20, 2013.
(Continued)

*Primary Examiner* — James O Hansen
(74) *Attorney, Agent, or Firm* — Burr & Brown, PLLC

(57) ABSTRACT

An assembly for opening/closing doors including at least a first wing, a second wing and a mechanism adapted to move the wings from a closing position wherein they lie in a vertical plane, to an opening position wherein they are arranged facing each other and lying onto parallel and substantially horizontal planes, and vice versa. The passage from the closing position to the opening position and vice versa occurs through a synchronized and simultaneous rotary-translating motion of the wings. The mechanism includes first and second kinematic arrangements respectively adapted to move the first and second wings, the kinematic arrangements being separate and distinct, kinematically connected through a mechanism for synchronizing and changing the transmission ratio to impart a differential
(Continued)

trajectory to the synchronized motion of the first wing with respect to the second wing during closing and opening.

11 Claims, 9 Drawing Sheets

(51) Int. Cl.

| | |
|---|---|
| ***E05D 13/00*** | (2006.01) |
| ***E05D 15/44*** | (2006.01) |
| ***E05F 15/665*** | (2015.01) |
| ***E05F 15/686*** | (2015.01) |
| ***E05F 1/02*** | (2006.01) |
| ***E05F 7/08*** | (2006.01) |
| ***E06B 3/44*** | (2006.01) |

(52) U.S. Cl.
CPC ..... *E05F 7/08* (2013.01); *E05F 15/665* (2015.01); *E05F 15/686* (2015.01); *E05F 17/004* (2013.01); *E06B 3/44* (2013.01); *E06B 3/5009* (2013.01); *E06B 3/5045* (2013.01); *E05F 2017/005* (2013.01); *E05Y 2201/62* (2013.01); *E05Y 2201/648* (2013.01); *E05Y 2900/20* (2013.01)

(58) Field of Classification Search
USPC ..... 312/139.1, 319.1, 319.4, 319.5, 322, 323,312/325, 327; 49/197, 198, 200, 203; 160/218, 160/189, 190
See application file for complete search history.

(56) References Cited

U.S. PATENT DOCUMENTS

| | | | | |
|---|---|---|---|---|
| 2,997,041 | A | 8/1961 | Wolske | |
| 5,020,580 | A * | 6/1991 | Dalman | E05D 15/262 160/188 |
| 6,877,830 | B2 * | 4/2005 | Salice | E05D 15/262 312/319.2 |
| 2002/0113532 | A1 | 8/2002 | Hornberger et al. | |
| 2009/0261696 | A1 * | 10/2009 | Hollenstein | A47B 77/00 312/327 |
| 2011/0036015 | A1 * | 2/2011 | Archer | E05D 15/262 49/197 |
| 2013/0334944 | A1 * | 12/2013 | Karg | E05D 15/262 312/237 |

OTHER PUBLICATIONS

International Search Report (Application No. PCT/IB32013/056405) dated Oct. 9, 2013.

* cited by examiner

ASSEMBLY FOR OPENING/CLOSING OF WINGS THROUGH SYNCHRONIZED MOTION

CROSS REFERENCE TO RELATED APPLICATIONS

This application is a continuation of International Application No. PCT/IB2013/056405 filed Aug. 5, 2013, which designated the United States, and claims the benefit under 35 USC §119(a)-(d) of Italian Application No. PN2012A000046 filed Aug. 9, 2012, the entireties of which are incorporated herein by reference.

FIELD OF THE INVENTION

The present invention is related to an assembly for opening/closing doors/wings through a synchronized motion. In particular, the present invention is referred to an assembly for opening/closing provided with a first and a second wing, and with a mechanism which makes it possible to move the wings between a closing position and an opening position, and vice versa, so that the motion of the first wing is synchronized and simultaneous with the motion of the second wing.

BACKGROUND OF THE INVENTION

Generally, in the home furnishing field, the pieces of furniture are made of parallelepiped bodies, formed as it is known, by two parallel vertical sides, a top, a bottom and in case a back wall, which define an internal compartment wherein it is possible to place objects, foods, clothes, etc.

The front opening whereby the internal compartment is accessed is associable to one or more wings which can pass from a closing position in which the access to the compartment is prevented to an opening position, in which it is possible to access the content of the internal compartment, and vice versa.

Generally, the wings can be "side-hung", that is hinged on the piece of furniture so as the passage from one position to the other occurs by rotating around a horizontal or vertical axis, therefore requiring considerable space to open, or sliding so as the passage from one position to the other occurs through side or vertical sliding, therefore making part of the internal compartment barely accessible, or inaccessible.

The German Utility Model No. 20121033 U1 shows a piece of furniture provided with a double wing opening/closing mechanism: in particular, the first wing and the second wing are arranged so as, in the closing position of the internal compartment of the piece of furniture, they are superimposed and lying on the same vertical plane, while in the opening position of the internal compartment of the piece of furniture the wings are arranged facing two parallel horizontal planes, completely overhanging in correspondence of the top of the piece of furniture.

The passage between the closing position and the opening position, and vice versa, occurs by means of synchronized and simultaneous rotary-translating motion of both wings, that is a rotation around horizontal axes in the same direction and at the same time vertical translation in the same direction, upward in the opening position and downward in the closing position, achieved thanks to articulated and slidable arms through a rack within two side guides provided in the front part of the sides of the piece of furniture.

However, this mechanism has some inconveniences. In fact, in order to achieve the passage from the closing position to the opening position of the compartment and therefore access its content, it is necessary for the user to impart the necessary force to operate the motion of both wings to the lower wing whereon a suitable handle is provided: therefore, besides the weight of the wings themselves, the user is moreover in the condition to have to win the resistance from the articulated arms and sliding friction of the rack. This can be rather burdensome when opening, especially if the piece of furniture has considerable dimensions, such as in the case of a wardrobe.

On the contrary, in the passage between the opening position and the closing position it is necessary to follow through the motion of the wings in order to prevent sudden and dangerous closing because of the weight of the same wings. Moreover, this opening/closing mechanism does not make it possible to block the motion of the two wings in an intermediate position.

Finally, the vertical sliding by means of a rack is rather noisy and it requires maintenance and lubrication, as well as the articulated arms, in order to ensure a sufficient motion smoothness.

In order to further reduce the necessary space for the opening/closing operations of the piece of furniture other solutions have been suggested, for example, pieces of furniture with only one wing wherein the opening occurs with a rotary motion of the wing which ends when it is a substantially horizontal position above the top of the piece of furniture. If required, there can be provided mechanism adapted to assist the motion, such as spring or hydraulic or pneumatic pistons. One example of such solution is described in the U.S. Application Publication No. 2002/0113532 A1.

Even if this solution is well apt for wall units which extend in length and much less in height, it cannot be used in any way for wardrobes, which generally extend for the whole height of the room leaving little hollow space between the top of the piece of furniture and the ceiling.

GB 1257999 A1 shows an assembly for closing pieces of furniture comprising two rectangular wings hinged one with the other along two sides of the same length and wherein the lower wing is provided with guide pins in correspondence with the side opposed to the hinged ones and sliding within side grooves. In order to open the piece of furniture, the guide pins of the lower wing are caused to slide vertically within the side grooves until the two wings are arranged facing each other and lying on two horizontal planes; then, the opening position is reached making the two wings slide horizontally inside the piece of furniture, just below its top.

This opening mechanism is rather inconvenient as in the passage between the closing position and the opening position, the user is in the trajectory of the wings; moreover, even if it makes it possible to house the wings inside the piece of furniture, they have to be first "packed" and then be slidably inserted and therefore, actually, the space required for the opening/closing operations is substantially equal to the width of one wing. Further, it is not provided any aid for the opening of the wings whose whole weight has therefore to be lifted by the user.

SUMMARY OF THE INVENTION

The main object of the present invention is that of overcoming the inconveniences of the known art devising an assembly for opening/closing doors with a synchronized motion which requires a reduced space for the opening/closing operations.

In the field of opening/closing doors, an important object is that of devising an assembly for opening/closing doors, in particular, for pieces of furniture or container compartments, wherein in the opening position it is possible the free access to the whole internal space of the compartment.

Another object of the present invention is that of providing an assembly for opening/closing doors which is really smooth, silent and long-lasting without any need for maintenance.

A further object of the present invention is that of providing an assembly for opening/closing doors assisted by counterbalancing means which make it possible to move the wings with a minimum effort by the user, also allowing to keep intermediate position safely.

Not the least object is that of devising an assembly for opening/closing doors with a synchronized motion which can achieve the above opening/closing task and the objects and which can be obtained with the usual and known plants, machineries and equipment.

BRIEF DESCRIPTION OF THE DRAWINGS

Further characteristics and advantages which can be achieved through an assembly for the synchronized opening/closing doors according to the present invention will become more apparent from the following description of a particular, but not excluding, form of embodiment described for exemplification only but not limited to with reference to the following figures.

DETAILED DESCRIPTION OF THE INVENTION

An assembly for opening/closing doors according to the present invention comprises at least a first wing and a second wing and a mechanism adapted to move simultaneously the first and second wing between a closing position, wherein they lie superimposed on a same substantially vertical plane, and an opening position wherein they are arranged facing each other and lying on two parallel and substantially horizontal planes, and vice versa; in particular, the passage from the closing position to the opening position, and vice versa, occurs through a synchronized and simultaneous rotary-translating motion of the wings.

According to a characteristic of the invention, the mechanism comprises a first and second kinematic arrangement adapted to move the first and second wing, respectively, the kinematic arrangements being separate and distinct but kinematically connected through means for synchronizing the motion and changing the transmission ratio to impart a differential trajectory to the synchronized motion of the first wing with respect to the second wing in the passage between the closing position to the opening position and vice versa.

With reference to the foregoing figures, there is shown an assembly for opening/closing doors through a synchronized motion applied to a piece of furniture 1 according to the present invention.

Figure 1B:
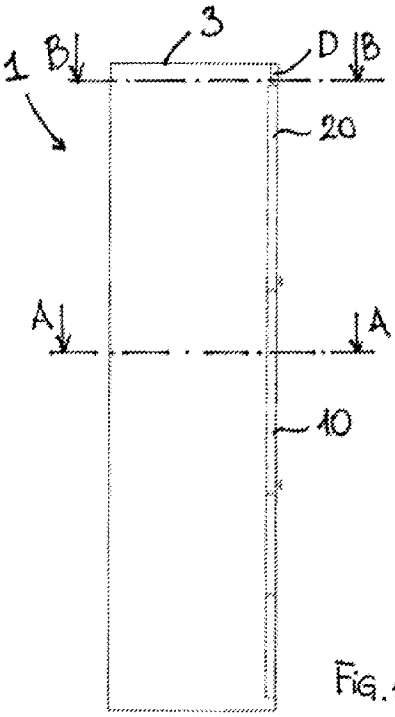
FIGS. 1 A, 1B and 1C show, respectively, according to a front view, a side view and a top view, a piece of furniture provided with an assembly for opening/closing doors according to the present invention.
Figure 1A:
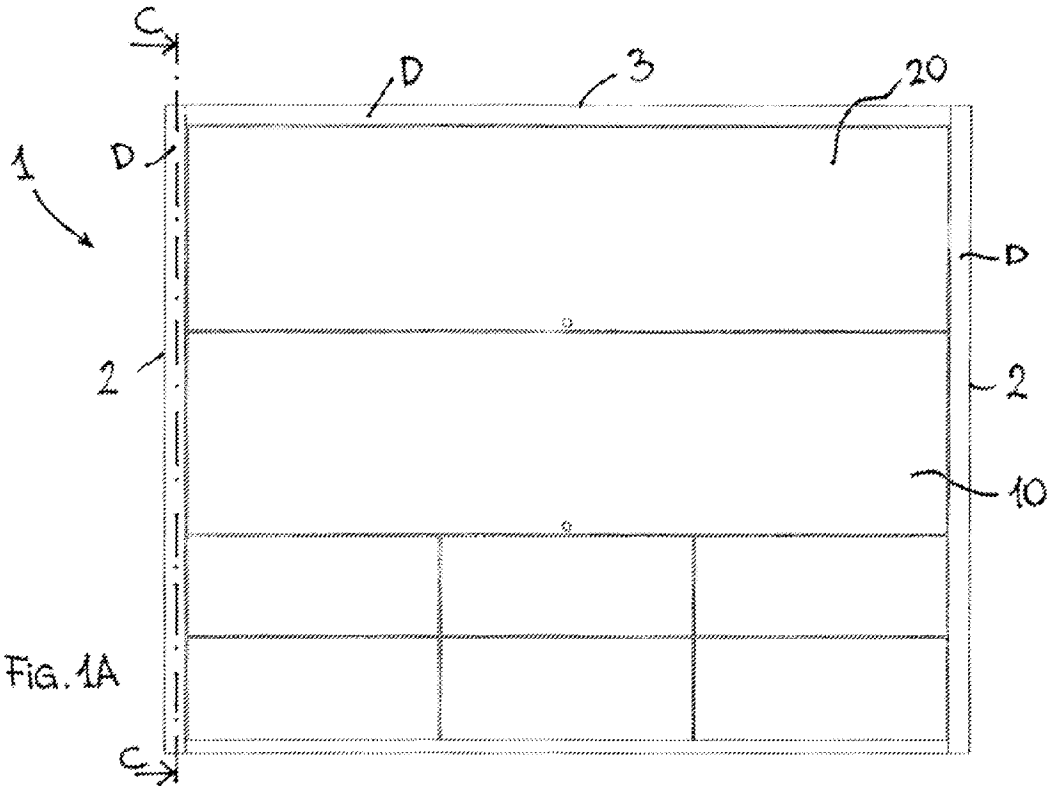
Figure 1C:
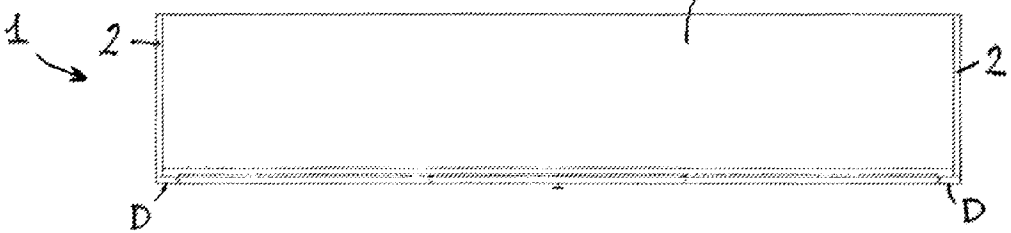

The piece of furniture 1 comprises a parallelepiped body formed by two substantially parallel vertical sides 2, a top 3, a bottom 4, and in case a back wall (FIGS. 1A, 1B, and 1C). The parallelepiped body defines an internal compartment 6 wherein it is possible to place objects, foods, clothes, etc.

It is to note that the directional terms herewith used to describe the present invention, such as "on, under, vertical, horizontal, lower, upper", as well as any other similar directional term, are to be understood with reference to an assembly for opening/closing doors according to the present invention when in use.

An assembly for opening/closing according to the present invention comprising a first wing 10, and a second wing 20, herewith respectively called as lower wing 10 and upper wing 20 because of their arrangement when used, and associable to the front opening of the piece of furniture 1 through which it is possible to access the content of the internal compartment 6.

The assembly of opening/closing doors further comprises a mechanism 100 adapted to move the wings 10, 20 between a closing position (FIG. 2A), wherein the wings 10, 20 are arranged so as to cover the front opening of the internal compartment 6 and lie on the same vertical plane, therefore being coplanar, superimposed by means of two sides of the same length, though being mechanically separate, and an opening position (FIG. 4), wherein they lie facing each other on two parallel and substantially horizontal planes in correspondence of the upper part of the piece of furniture 1, so as to make it possible for the user to access said internal compartment 6.

Figure 4:
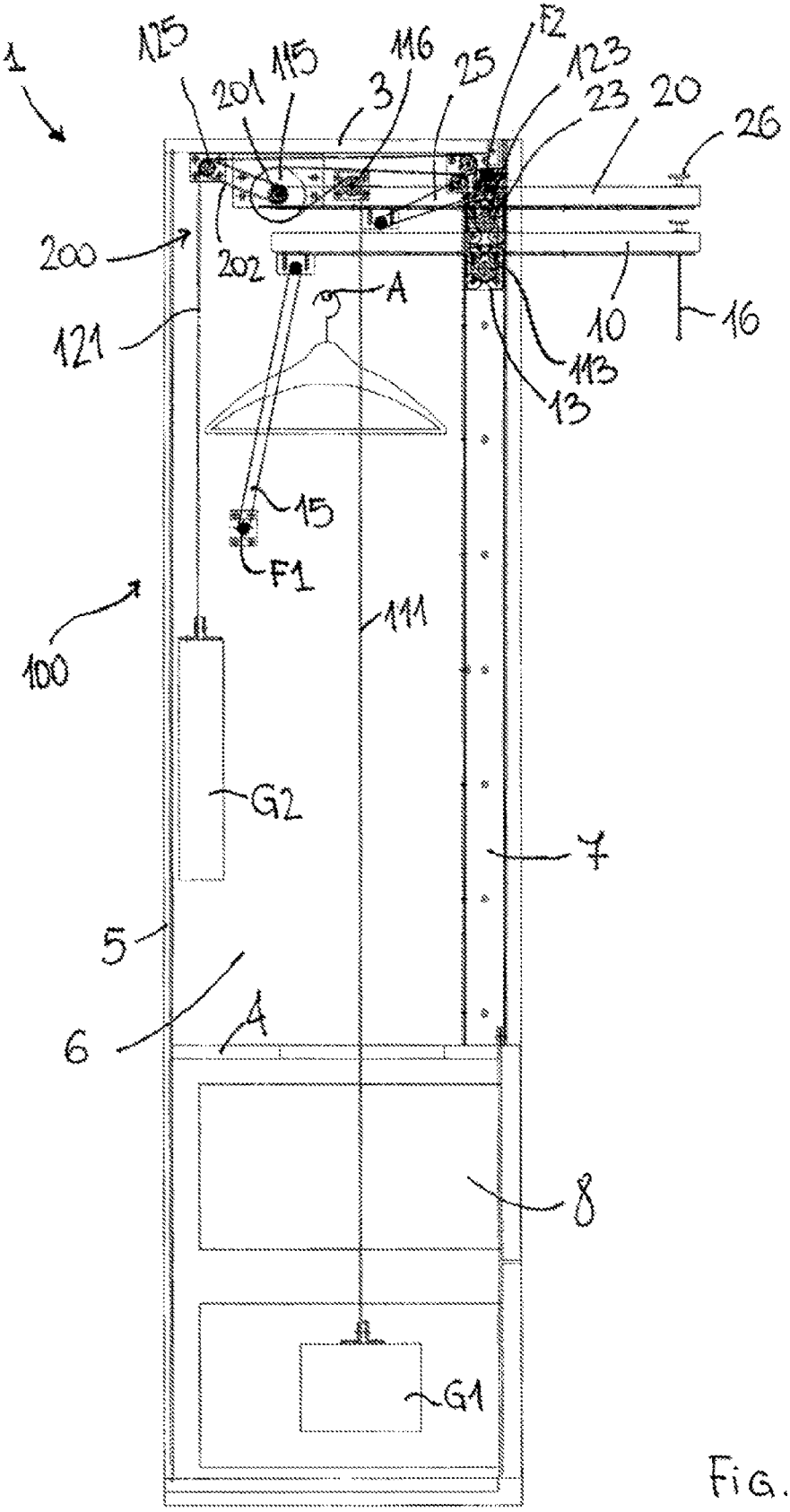
FIG. 4 is a sectional view along the plane C-C of the piece of furniture shown in FIG. 1A showing the opening/closing assembly of the present invention wherein the wings are arranged in the opening position.
Figure 5:
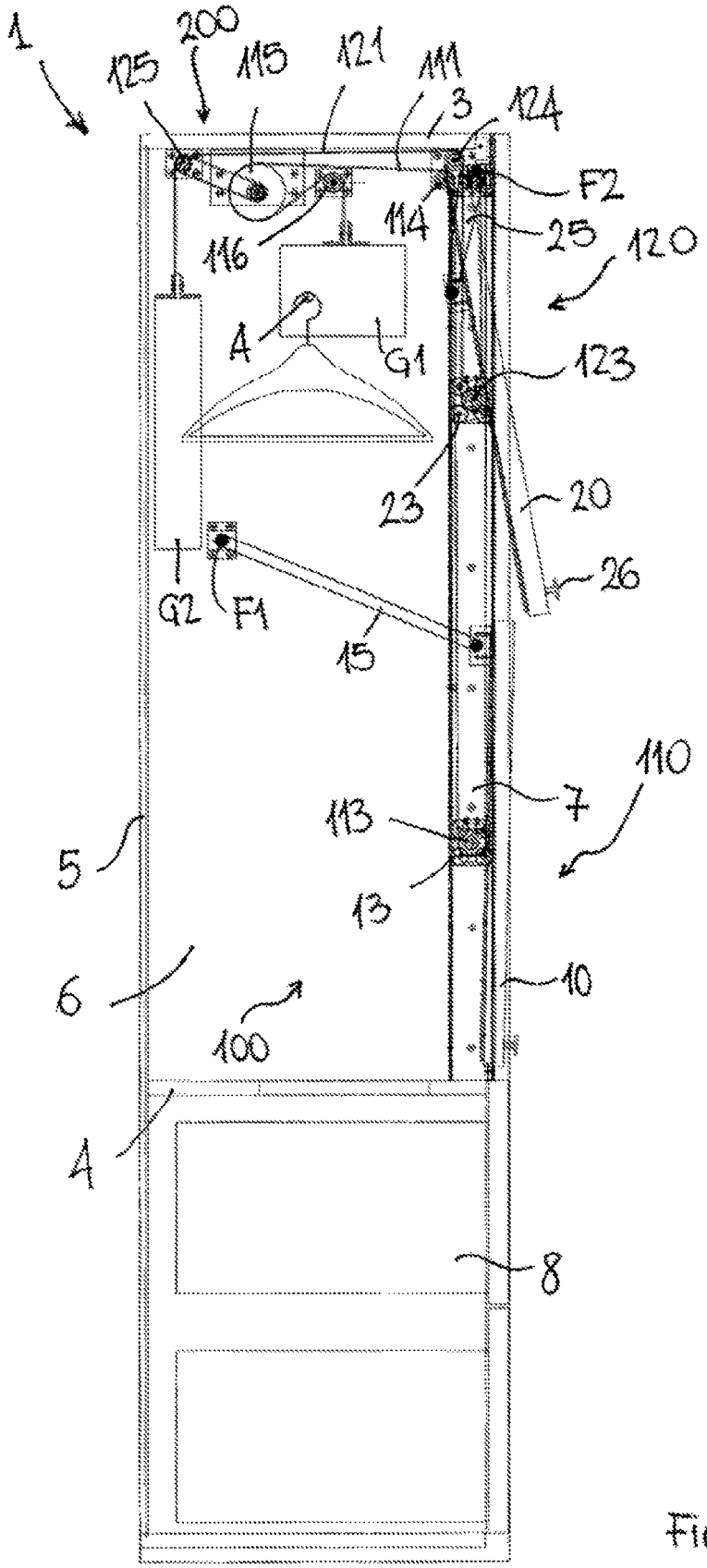
FIGS. 5, 6 and 7 show a sequence of steps in the passage between the closing position and the opening position in an assembly for opening/closing doors with a synchronized motion according to the present invention.
Figure 6:
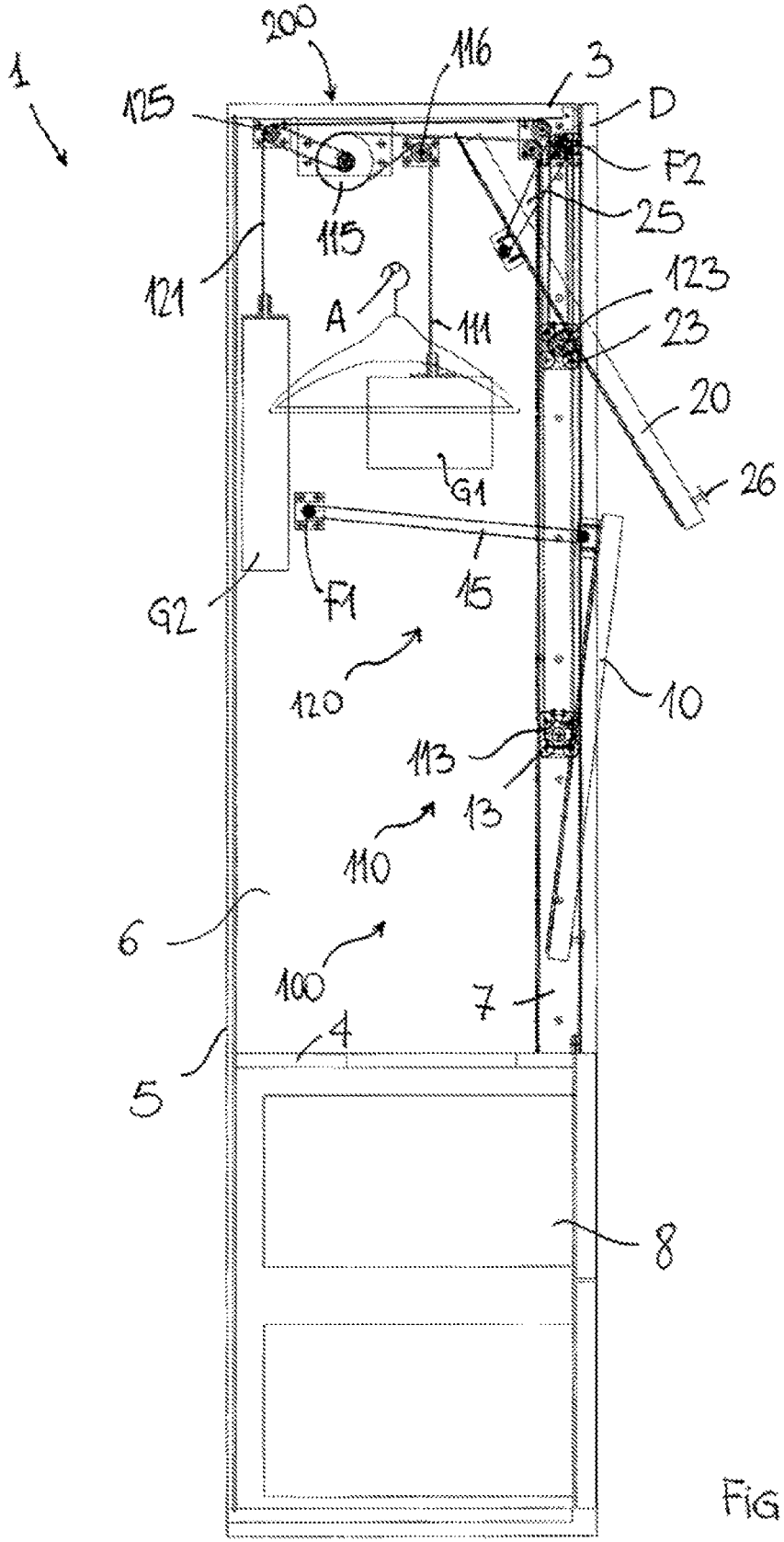
Figure 7:
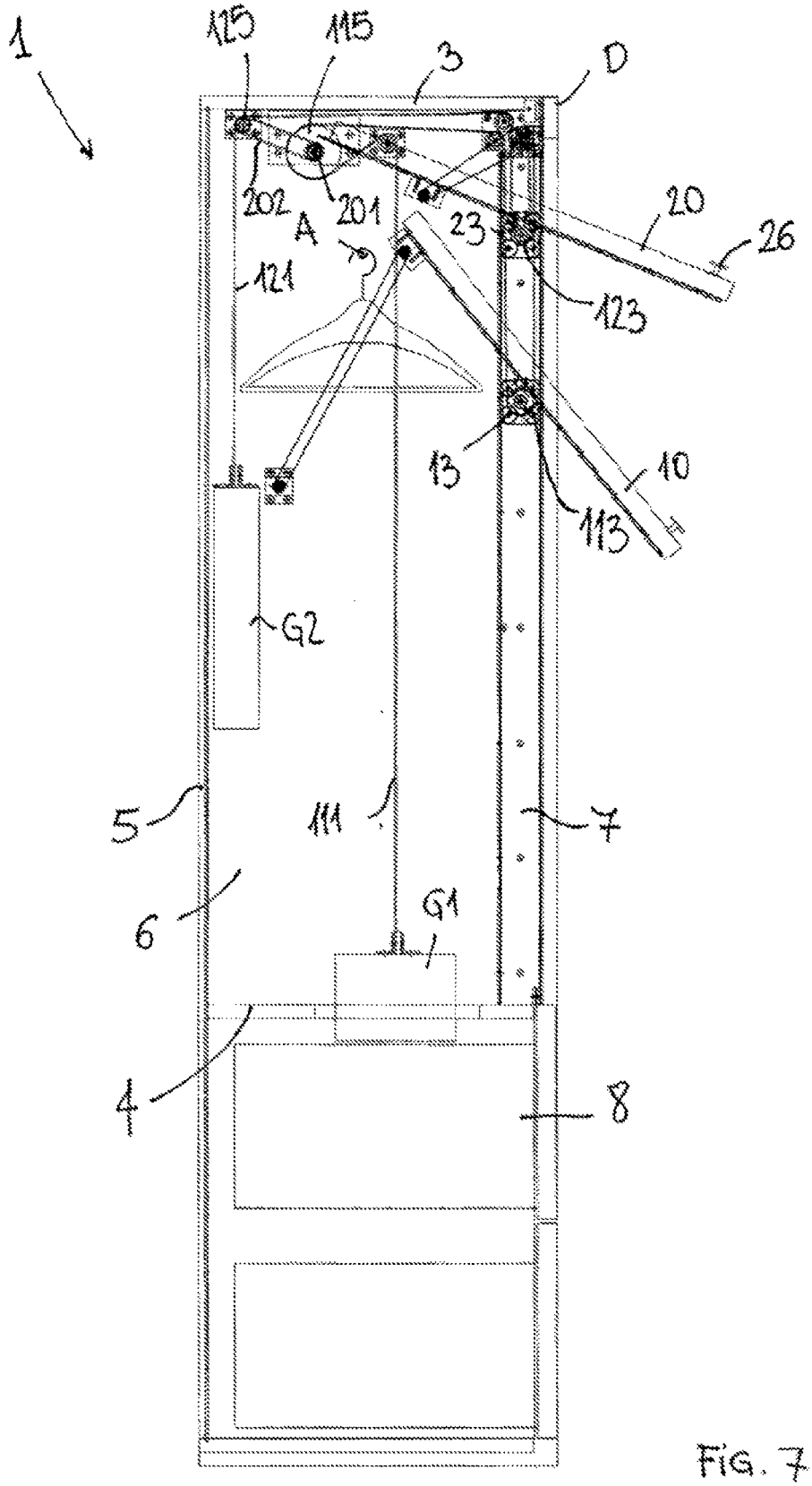

According to a particularly advantageous characteristic of the present invention, as later shown in a more detailed way, in an opening position the first and second wing 10, 20 are at least partially housed within the compartment 6, adjacent to the top 3 of the piece of furniture 1, as shown in FIG. 4.

The passage between the closing position and the opening position, and vice versa, occurs through a simultaneous and synchronized rotary-translating motion of the two wings 10, 20: in other words, in the opening/closing motion, both wings 10, 20 make a rotation having the same rotation direction around horizontal axes, and a concurrent vertical translation in the same direction.

Mechanism 100 of the present invention which makes it possible to obtain these movements comprises a first kinematic arrangement 110 adapted to move the lower wing 10 and a second kinematic arrangement 120, adapted to move the upper wing 20.

In particular, the two kinematic arrangements 110, 120 are kinematically distinct and separate; as described later in a more detailed way, in order to obtain the synchronized motion of the two wings 10, 20 and impart them a differential trajectory based on their different position, the two kinematic arrangements 110, 120 are effectively connected through means for synchronizing the motion and changing the transmission ratio 200.

Moreover, according to an advantageous characteristic of the present invention, the opening/closing motion of the two wings 10, 20 is assisted, that is counterbalanced, thanks to the presence of suitable counterbalancing means G1, G2.

Both kinematic arrangements 110, 120 substantially follow the block and tackle scheme to lift heavy loads: the member to be lifted is associated to a motion transmission means, such as a rope or a toothed belt, having an end constrained to a top wall and the opposed end associated to a counterbalancing means such as a solid body acting as a counterweight. A transmission means are adapted to engage a plurality of suitably arranged transmission elements, and the distance covered by the counterweight must substantially be twice the distance covered by the element to be lifted.

In particular, the transmission means preferably comprises at least a fixed pulley attached to the top wall and at least a movable pulley arranged integrally to the element to be lifted. The assembly reaches a condition of theoretic balance if the mass of said counterweight is substantially equal to half the mass of the element to be lifted.

Figure 3B:
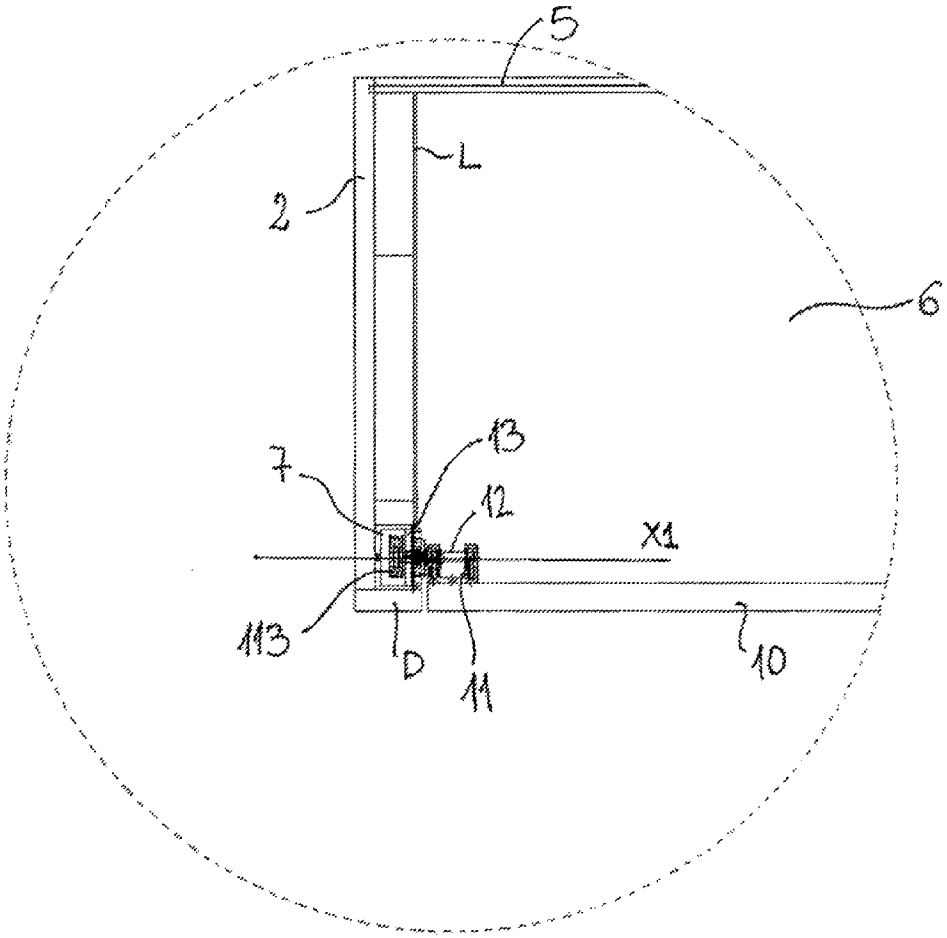
FIG. 3B shows an enlarged version of the circled area in FIG. 3A.
Figure 3A:
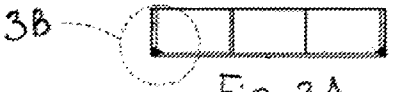
FIG. 3A is a view of the piece of furniture cut along the horizontal plane A-A shown in FIG. 1B.
Figure 3D:
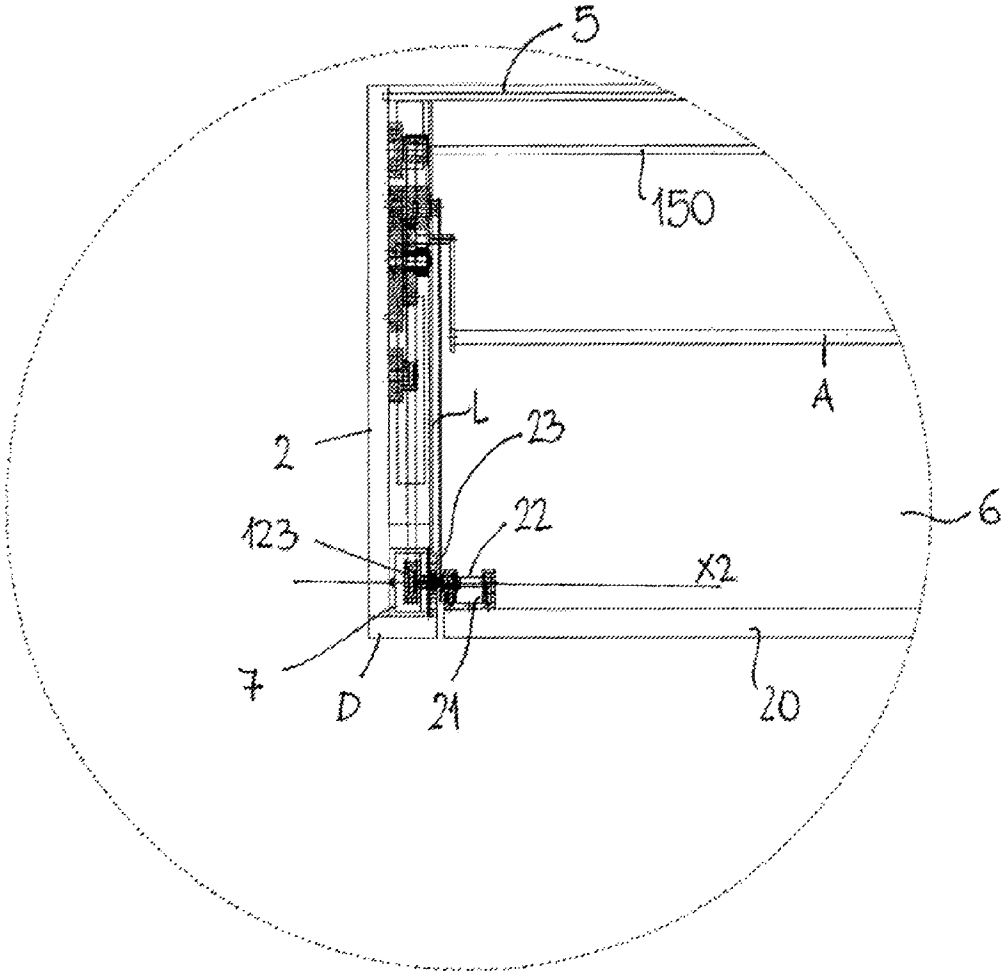
FIG. 3D shows an enlarged version of the circled area in FIG. 3C.

Herewith will be described the two distinct kinematic arrangements 110, 120 which make it possible to move independently wings 10, 20. Each kinematic arrangement 110, 120 comprises pairs of elements symmetrically arranged on the vertical sides of the piece of furniture 1, preferably housed inside cavities made adjacent the sides 2, that is made between the sides 2 and corresponding inside partition walls L closed at the front by a perimetral frame D, as can be seen in FIGS. 3B and 3D.

With reference to FIGS. 2, 2A and 3A-3D, there will be described the members composing each kinematic arrangement 110, 120 arranged on one of the two sides of the piece of furniture 1. Of course, the arrangement of the composing members on the other side will be symmetrical.

The first kinematic arrangement 110 comprises a first transmission means 111, a first sliding member 13, a first plurality of transmission elements 113, 114, 115, 116, and a first counterbalancing means G1 to act as a counterweight.

The first sliding member 13, preferably made of a trolley provided with wheels, slidably movable along a vertical direction inside a guide groove 7, preferably C-shaped provided on the vertical side 2 of the piece of furniture and substantially extending along the entire height of compartment 6. The first lower wing 10 is rotatably associated to the first sliding members 13, provided on each side of the piece of furniture 1, through first pins 12, projecting from the side surfaces of the lower wing 10, preferably in correspondence with an essentially central portion of the vertical extension of the same wing. In this way the lower wing 10 is freely rotatable around a first horizontal axis X1, defined by the extension of the first pins 12, as can be seen in FIGS. 3A-3B.

In particular, each of the first pins 12 is attached to the lower wing through a fixing plate 11, preferably L-shaped, provided on the back face of the wing 10, that is on the surface facing the internal compartment 6 of the piece of furniture 1.

A first movable transmission element 113, such as a pulley, is mounted on the first sliding member 13, being therefore able to move integrally to it. In particular, the first movable pulley 113 is arranged coaxially to the first pin 12, and it is rotatable around the first horizontal axis X1. The first movable pulley 113 is the connecting element between said first kinematic arrangement 110 and the lower wing 10, having the function of transmitting the vertical motion to the wing and that of bearing its weight.

A first transmission means 111, preferably a toothed belt, is attached at one end to the top wall of the piece of furniture 1, in correspondence of the upper end portion of said guide groove 7 through a first fixing element 112; the opposed end of said first transmission means 111 is on the contrary associated to a first counterbalancing means G1 such as a solid body.

Following the development of the first toothed belt 111 starting from its first end, it extends within the first groove 7, it winds around the first movable pulley 113 being pushed back by it by 360°, and still developing within the groove 7, it exits it at its upper end portion, substantially in the proximity of the first fixing element 112.

Subsequently, the first toothed belt 111 undergoes a number of transmissions around a corresponding plurality of fixed transmission means, attached to side 2 of the piece of furniture 1, for example, in the appended figures there are shown for exemplification only but not limited to, a first front pulley 114 being adapted to transmit a movement of basically 90° to the first toothed belt 111 towards the interior of the piece of furniture 1, a first intermediate transmission pulley 115, it too fixed to side 2 of the piece of furniture and preferably having a diameter greater than that of the first pulley 114, which again transmits the movement to the first toothed belt 111 towards a first supporting pulley 116, fixed to side 2 of the piece of furniture in an intermediate position between the front pulley 114 and the intermediate transmission pulley 115, whereon the weight of the first solid body G1 acting as a counterweight for the lower wing 10 is unloaded.

Advantageously, the mass of the first solid body G1 has to be at least equal, and preferably greater in order to take into account the frictions which develop between the elements forming the kinematic arrangement, to a quarter of the mass of the lower wing 10, that is, in other words, the sum of the masses of the first solid bodies G1 arranged on each side of wing 10 has to be at least equal to half the mass of the first wing 10, in this way, in fact, every moment the first wing moves from the closing position to the opening position, and vice versa, the system is in balance. Therefore, advantageously, in the passage between the closing position and the opening position and vice versa, the lower wing 10 can be safely blocked in a plurality of intermediate positions.

Moreover, preferably, the travel of the first solid body G1, calculated as the distance which the solid body G1 has to cover in order to pass from the closing position to the opening position, and vice versa, is substantially twice with respect to the travel of the lower wing 10, calculated as the distance that the first sliding member 13 has to cover in order to pass from the closing position to the opening position, and vice versa.

According to a preferred embodiment of the present invention, the first transmission means 111 consists in a toothed belt provided with toothing only in correspondence of one of the two faces; instead, the opposed face is even. The toothing of the belt 111 is adapted to engage on the corresponding toothing of the first front pulley 114 and of the first intermediate transmission pulley 115, both advantageously formed of toothed wheels; the first movable pulley 113 and the first support pulley 116 can, on the contrary, be formed of sheaves, that is pulleys having an even race on their outer surface as the engaging between the toothed belt and said pulleys 113, 116 takes place through the face without toothing.

The means and the elements belonging to the first kinematic arrangement 110 described so far make it possible to move vertically the lower wing 10 with a minimum effort by the user. In fact, it is sufficient to apply a slight pull in order to unbalance the balance counterweight G1/lower wing 10, both when opening and when closing, and therefore operate the motion in the desired direction.

The kinematic arrangement 110 further comprises a first arm 15, provided in order to give the lower wing 10 the rotary-translating motion so as to enable the same, in the opening position, to place itself lying on a substantially horizontal plane and at least partially housed within compartment 6 of the piece of furniture 1, below top 3.

The first arm 15 comprises an elongated rigid body, preferably of metal, rotatably associated with one end to side 2 of the piece of furniture around a first fulcrum F1 and with the opposed end attached to the lower wing 10, through suitable connecting means.

The position of the first fulcrum F1 and of the connecting means on the wing 10, and the length of the first arm 15 define the trajectory of the lower wing 10.

Figure 8:
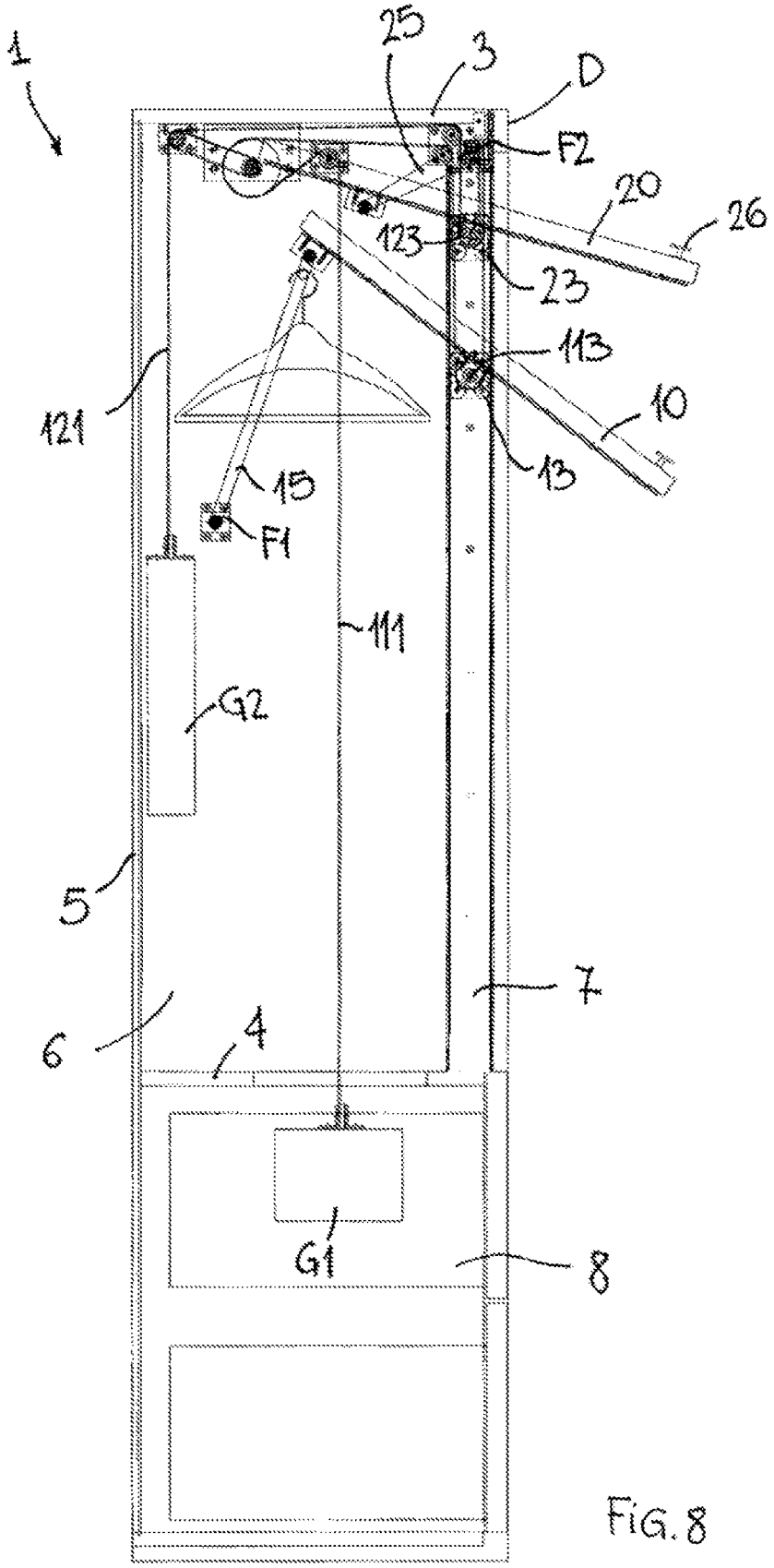
FIG. 8 shows a particular step called "dead point" in the passage between the closing position and the opening position in an assembly for opening/closing doors with a synchronized motion according to the present invention.

Moreover, advantageously, due to the directrixes of the force resulting from the arrangement of the above said elements, when the lower wing 10, passing from the closing position to the opening position, goes beyond a "dead point", shown in FIG. 8, it autonomously continues its motion towards its stop, without any need of pull by the user; in this way, it is therefore possible to obtain the complete opening/closing of the wing 10 by short users as well.

Similarly, the second kinematic arrangement 120, adapted to move the upper wing 20 comprises a second transmission means 121, a second sliding member 23, a second plurality of transmission elements 123, 124, 125, and a second counterbalancing means G2 acting as a counterweight.

The second sliding member 23, preferably a wheeled trolley, is slidable along the vertical direction within a guide groove 7, preferably C-shaped, provided on side 2 of the piece of furniture and substantially extending along the whole height of compartment 6. The upper wing 20 is rotatably associated to the second sliding members 23, provided on each side of the piece of furniture 1, through second pins 22, projecting from the side surfaces of the upper wing 20, preferably in correspondence of a substantially central portion of the vertical extension of the same wing. In this way, the upper wing 20 is freely rotatable, around a second horizontal axis X2, defined by the extension of the second pins 22, as it can be seen in FIGS. 3C-3D.

In particular, each of the second pins 22 is attached to the upper wing 20 through a fixing plate 21, preferably L-shaped, provided on the rear face of the upper wing 20, that is the surface facing the internal compartment 6 of the piece of furniture 1.

A second movable transmission element 123, such as a pulley, is mounted on the second sliding member 23, being therefore able to move integrally to it. The second movable pulley 123 is coaxially mounted on the second pin 22, therefore rotatable around second the horizontal axis X2. The second movable pulley 123 is the connecting element between the second kinematic arrangement 120 and the upper wing 20; moreover, the weight of the upper wing 20 is unloaded on the second movable pulley 123.

A second transmission means 121, preferably a toothed belt, is attached at one end to the top wall of the piece of furniture 1, in correspondence of the upper end portion of the guide groove 7, through a second fixing element 122; the opposed end of the second toothed belt 121 is on the contrary associated to a second counterbalancing means G2 such as a solid body.

Following the development of the second toothed belt 121 starting from its first end, it extends within the first groove 7, it winds around the second movable pulley 123 being pushed back by it by 360°, and still developing within the groove 7, it exits it at its upper end portion, substantially in the proximity of the second fixing element 122.

Therefore, the guide groove 7 shall have a width such as to allow within it, besides the sliding of the first and second sliding member 13, 23, also the passage of the first and second transmission means 111, 121 in double turn.

Subsequently, the second toothed belt 121 undergoes a number of transmissions around a corresponding second plurality of fixed transmission means, attached to side 2 of the piece of furniture 1. For example, in the appended figures there are shown for exemplification only but not limited to, a second front pulley 124 being adapted to transmit a motion of basically 90° to the second toothed belt 121 towards the interior of the piece of furniture 1, and fixed to side 2 of the piece of furniture 1 adjacent to the back 5, there is a second support pulley 125 whereon it is unloaded the weight of the first solid body G2 acting as a counterweight for the upper wing 20.

Advantageously, the mass of the second solid body G2 has to be at least equal, and preferably greater in order to take into account the frictions which develop between the elements forming the kinematic arrangement, to a quarter of the mass of the upper wing 20, that is, in other words, the sum of the masses of the second solid bodies G2 arranged on each side of wing 20 has to be at least equal to half the mass of the second wing 20: in this way, in fact, every moment the second wing moves from the closing position to the opening position, and vice versa, the assembly is in balance. Therefore, advantageously, in the passage between the closing position and the opening position and vice versa, the upper wing 20 can be safely blocked in a plurality of intermediate positions.

Moreover, preferably, the travel of the second solid body G2, calculated as the distance which the solid body G2 has to cover in order to pass from the closing position to the opening position, and vice versa, is substantially twice with respect to the travel of the upper wing 20, calculated as the distance that the second sliding member 23 has to cover in order to pass from the closing position to the opening position, and vice versa.

According to a preferred embodiment of the present invention, the second transmission means 121 consists in a toothed belt provided with toothing only in correspondence of one of the two faces; instead, the opposed face is even. The toothing of the belt 121 is adapted to engage on the corresponding toothing of the second front pulley 124 and of the second support pulley 125, both advantageously formed of toothed wheels; the second movable pulley 123 can, on the contrary, be formed by a sheave, that is a pulley having an even race on its outer surface as the engaging between the toothed belt 121 and the movable pulley 123 takes place through the face without toothing.

Means and elements belonging to the second kinematic arrangement 120 described so far make it possible to move vertically the upper wing 20 with a minimum effort by the user: in fact, it is sufficient to apply a slight pull in order to unbalance the balance counterweight G2/upper wing 20, both when opening and when closing, and therefore operate the motion in the desired direction.

The kinematic arrangement 120 further comprises a second arm 25, provided in order to give the upper wing 20 the rotary-translating motion so as to enable the same, in the opening position, to place itself lying on a substantially horizontal plane and at least partially housed within compartment 6 of the piece of furniture 1, adjacent to the top 3.

The second arm 25 comprises an elongated rigid body, preferably of metal, rotatably associated with one end to side 2 of the piece of furniture around a second fulcrum F2 and with the opposed end attached to the upper wing 20, through suitable connecting means.

The position of the second fulcrum F2 and of the connecting means on the upper wing 20, and the length of the second arm 25 define the trajectory of the upper wing 20.

Advantageously, due to the directrixes of the force resulting from the arrangement of the above the elements, when the upper wing 10, passing from the closing position to the opening position, goes beyond a "dead point", shown in FIG. 8, it autonomously continues its motion towards its stop, without any need of pull by the user; in this way, it is therefore possible to obtain the complete opening of both wings 10, 20 by short users as well.

According to a particularly advantageous characteristic, means 200 for synchronizing the motion are provided in order to kinematically engage the first and second kinematic arrangement 110, 120, so as to synchronize the motion of the lower wing 10 and the upper wing 20. In other words, the means 200 for synchronizing the motion ensure that moving one of the two wings 10, 20 in order to pass from a closing position to an opening position, and vice versa, the other one follows the motion of the first one.

However, it is necessary to take into account the different position of the wings 10, 20, which correspond to a different motion width necessary in order to pass from the closing position to the opening position, and vice versa. Therefore, the means 200 for synchronizing the motion further comprise means for changing the transmission, through which it is possible to change the transmission ratio between the first kinematic arrangement 110 and the second kinematic arrangement 120.

The means 200 for synchronizing the motion and changing the transmission comprise a transmission pulley 201 mounted integral and coaxial to a pulley belonging to the first kinematic arrangement 110, and a third transmission means 202 formed by a closed loop toothed belt and adapted to be engaged both with the drive pulley 201 and with a pulley belonging to the second kinematic arrangement 120 to operate the kinematic connection between the first and the second kinematic arrangement 110, 120.

In particular, with reference to the appended figures for exemplification only, the drive pulley 201 is mounted integral and coaxial to the first intermediate transmission pulley 115 belonging to the first kinematic arrangement 110, and the third transmission means 202 can engage both with the drive pulley 201, and also with the second support pulley 125 belonging to the second kinematic arrangement 120, operating in this way the kinematic connection between the first and second kinematic arrangement 110, 120.

Advantageously, the ratio between the diameters of the first intermediate transmission pulley 115 and the drive pulley 201 is basically equal to the ratio between the travel of the first lower wing 10, calculated as the distance that the first sliding member 13 has to cover in order to pass from the closing position to the opening one, and the travel of the upper wing 20, calculated as the distance that the second sliding member 23 has to cover in order to pass from the closing position to the opening one; in fact, due to their arrangement, the upper wing 20 travel is shorter than the lower wing 10 travel, and therefore, as it can be seen in the appended figures, the diameter of the first intermediate transmission pulley is greater than the diameter of the drive pulley 201.

According to an advantageous characteristic of the invention, a fourth transmission means 150, such as a transmission shaft, can be provided between at least one pulley belonging to the first or to the second kinematic arrangement 110, 120 and arranged on one side 2 of the piece of furniture and the corresponding pulley arranged on the opposed side 2. Thanks to the presence of the transmission shaft 150 it is possible to give more smoothness to the opening/closing mechanism, being certain that the first and second sliding members 13, 23, provided respectively on the sides of the first and second wing 10, 20, remain perfectly parallel and aligned in the passage between the opening position and the closing position, and vice versa.

Figure 3C:
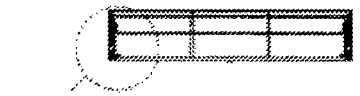
FIG. 3C is a view of the piece of furniture cut along the horizontal plane B-B shown in FIG. 1B.

Advantageously, as it can be seen in FIGS. 3C-3D, the transmission shaft 150 can be provided between the second support pulley 125 fixed on one side 2 adjacent to the back 5 of the piece of furniture 1, and the corresponding pulley 125 fixed on the opposed side 2.

If required powered actuator means, such as an electric motor, can be connected to the transmission shaft 150 to impart the torque necessary to actuate the motion of the first and second kinematic arrangement 110, 120 in response to an input sent by the user through suitable control means such as a button provided on the piece of furniture 1 or through a remote control as it is known by the skilled in the art.

In FIGS. 5, 6, 7 and 8 there are shown different steps of the passage of the wings 10, 20 from a closing position to an opening position: the first operation to carry on consists in setting the motion of the upper wing 20 going seizing it preferably by the first handling means 26, such as a handle. The handle 26 can be projecting with respect to the surface of the wing or made from a groove in the thickness of the same wing.

When setting the motion of the upper wing 20, the corresponding kinematic arrangement 120 is consequently actuated: because of gravity, the second solid body G2 will start its vertical travel as the balance upper wing 20/solid body G2 has been unbalanced. Such unbalancing makes the second transmission means 121 slide on the second support pulley 125 engaging itself on its toothing and therefore causing it to rotate.

As long as the user imparts a pull on the handle 26, the second body G2 continues its travel downward and therefore the second transmission means 121, as it is attached to the opposed end, drags upward the second sliding member making it slide within the guide groove 7, and obtaining the resulting lifting of the upper wing 20 integral to it.

Contextually to its linear vertical motion, the upper wing 20 swings in a controlled way around the second horizontal axis X2, thanks to the action of the second arm 25 which progressively guides the rotation around the second fulcrum F2. The resulting trajectory is such that it causes the upper wing 20 to make a rotary translating motion in order to pass from the closing position, wherein it lies on a vertical plane, to the opening position, wherein it lies on a horizontal plane and it is arranged at least partially housed within the compartment 6, adjacent to the top 3 of the piece of furniture 1.

Moreover, as it can be seen in the appended figures for exemplification only, if the upper wing 20 swings around an axis X2 which develops in an essentially central region with respect to the vertical extension of the same wing, the trajectory of the wing 20 in the passage between the closing position and the opening position is such that it provides a maximum dimension substantially equal to half the width of the upper wing 20 itself.

Concurrently to the motion of the upper wing 20, thanks to the presence of the means for synchronizing the motion and changing the transmission 200, the rotary motion of the support pulley 125 is transmitted to the first intermediate transmission pulley 115 belonging to the first kinematic arrangement 110, actuating the motion of the lower wing 10 as well.

In fact, the rotation of the first intermediate transmission pulley drags the first transmission means 111, unbalancing the assembly lower wing 10/first solid body G1 towards this one, which, due to gravity, starts its travel downward.

As the first solid body G1 continues its travel due to gravity, the first transmission means 111, as it is attached to the opposed end, drags upward the first sliding member 13, causing it to slide within the guide groove 7, and achieving the resulting lifting of the lower wing 10 integral to it.

Concurrently to its vertical linear motion, the lower wing 10 swings in a controlled way around the first horizontal axis X1, thanks to the action of the first arm 15 which guides the gradual rotation around the first fulcrum F1. The resulting trajectory is such that it causes the lower wing 10 to make a rotary translating motion in order to pass from the closing position, wherein it lies on a vertical plane, to the opening position, wherein it lies on a horizontal plane, parallel to the lying plane of the upper wing 20, it, too, at least partially housed within the compartment 6, adjacent to the top 3 of the piece of furniture 1.

Advantageously, as already said, when the wings 10, 20 go beyond a "dead point" (FIG. 8), they autonomously continue their opening motion, without any intervention of the user.

The opening position is reached in a stable and synchronized way by both wings 10, 20 when the second sliding member reaches an upper stop, substantially arranged in correspondence of the upper end portion of the guide groove 7, and the first sliding member 13 beats against the second sliding member 23, as it can be seen in FIG. 4.

The opposed motion, that is the passage of wings 10, 20 from an opening position to a closing position occurs in a substantially identical way, carried out backwards. In this case the user seizes the lower wing 10, if needed using second handling means 16, such as a tie rod associated to the lower wing 10 in particular in its lower inner portion, and starts the closing motion of the first kinematic arrangement 110. In this way he causes the unbalancing of the assembly first solid body G1/lower wing 10 towards this one, which, because of its weight, due to gravity starts the travel downward, therefore causing the first sliding member 13 associated to it to slide along the guide groove 7.

Moreover, applying a traction downward, the user makes the lower wing 10 rotate around the first horizontal axis X1; anyway, the rotation is controlled by the presence of the first arm 15, in such a way that the resulting trajectory will be a rotary translating motion which takes the lower wing 10 back to the closing position.

The upper wing 20 synchronically follows the motion of the lower wing 10, as the motion of the first kinematic arrangement 110 is transferred to the second kinematic arrangement 120 through the means for synchronizing and changing the transmission 200.

Figure 2A:
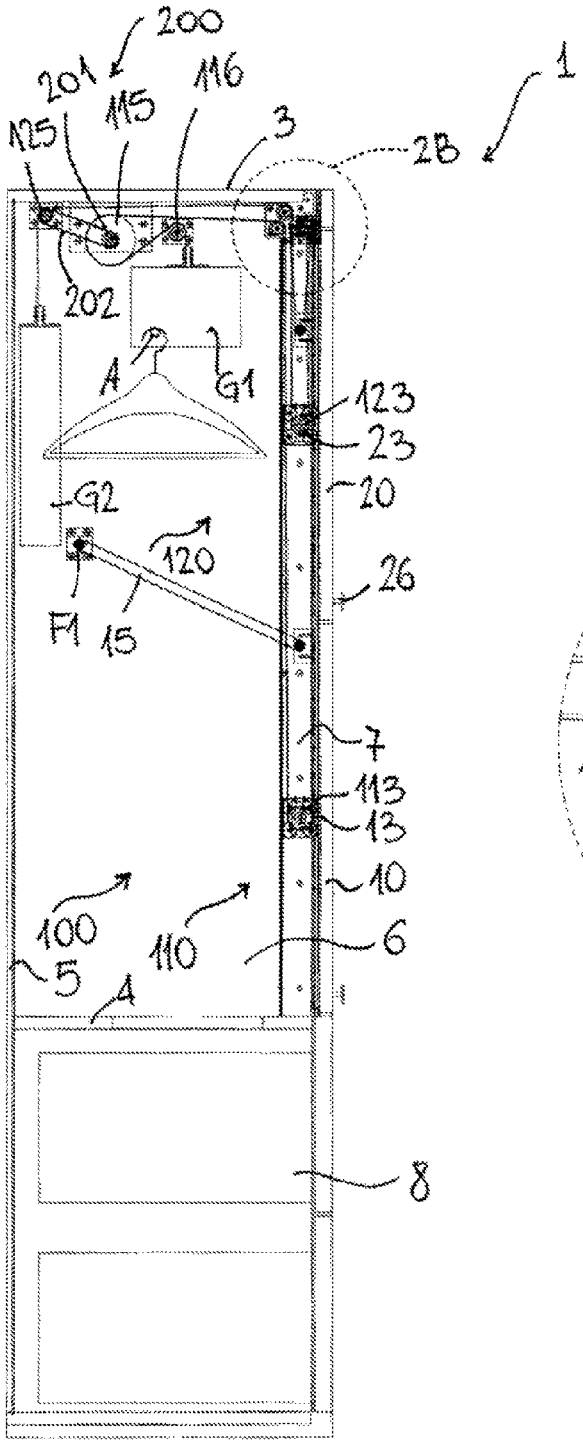
FIG. 2A is a sectional view along plane C-C of the piece of furniture shown in FIG. 1A showing an assembly for opening/closing doors according to the present invention wherein the wings are arranged in the closing position.
Figure 2B:
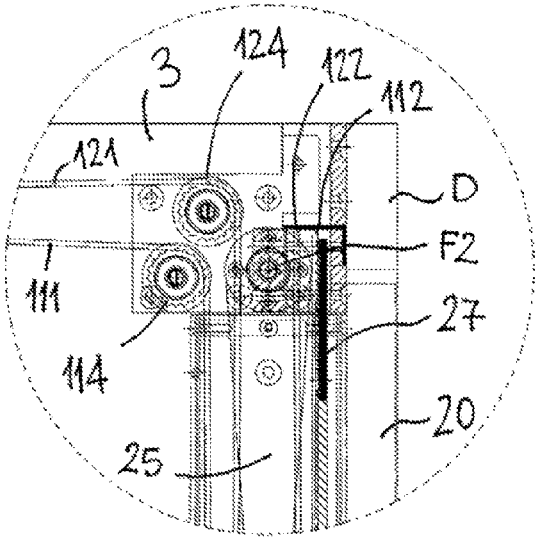
FIG. 2B shows an enlarged version of the circled area in FIG. 2A.

The closing position (FIGS. 2A-2B) is reached in a stable and synchronized way by the two wings 10, 20 when the outer upper portion of the upper wing 20 beats against a retainer means 27, such as a plate vertically projecting from the front portion of the top 3, as it is shown in FIGS. 2A-2B.

Advantageously, the piece of furniture 1 can comprise, below the internal compartment 6, a bottom 8 which forms a container compartment; the presence of the bottom 8 is advantageous as it enables the first and the second solid body G1, G2 to make a linear travel in the passage from a closing position to an opening position, as it can be seen in FIG. 4.

From the foregoing, it is therefore apparent that the present invention achieves the initially expected objects and the advantages.

In fact, it has been achieved an assembly for the synchronized opening/closing of wings which requires a reduced space for the opening/closing operations.

Such assembly has an advantageous application on a piece of furniture: in fact, in the opening position, the wings are at least partially housed inside the piece of furniture, adjacent to the top 3, in a very limited space and generally not used, allowing therefore the free access to the content of the internal compartment. As shown, for example, in the appended figures, when the assembly is applied to a wardrobe in order to house the wings in the opening position, it is possible to use the generally unused space included between top 3 and a possible clothes hanger A.

Moreover, as in the opening position the wings are inserted within the compartment 6 of the piece of furniture 1, it is advantageously possible to add other pieces of furniture or realize pieces of furniture as high as the ceiling, or which can be inserted inside recesses.

It is worthwhile observing that both wings, in the passage between the closing position and the opening position, always rest, at least partially, on the piece of furniture 1 and never completely overhanging, as they are provided rotatable around horizontal axes X1, X2 advantageously arranged centrally with respect to the vertical extension of the same wings.

Moreover, if the transmission means 11, 121, 202 comprise strong toothed belts and closed and self-lubricating closed bearings, the assembly for opening/closing doors is advantageously smooth, silent and long-lasting, and it does not need any maintenance.

A further advantage given by an assembly for opening/closing doors according to the invention is that of making it possible for the user to synchronically move at least two wings, even of considerable weight and dimensions, with a minimum effort thanks to the presence of counterbalancing means which constantly assist their motion. Moreover, thanks to the counterbalancing means, the wings can be safely kept in intermediate positions.

Finally, it is pointed out that an assembly for opening/closing doors according to the present invention, besides finding their application in the furnishing sector, in particular for kitchen furniture, wardrobes, etc., it can be advantageously used also for the opening/closing of garages, depots or other applications when it is needed to close or separate with doors a rear compartment or cavity.

Of course, the present invention can have a great number of applications or modifications and variations without exiting its protection field, as specified in the appended claims.

Moreover, the material and the equipment used in order to carry out the present invention, as well as the forms and dimensions of the single components, will be the most suitable ones depending on specific requirements.

The invention claimed is:

1. An assembly for opening and closing doors comprising at least a first door, a second door and a mechanism adapted to move said doors from a closing position, wherein said doors lie superimposed on a same substantially vertical plane, to an opening position wherein said doors are arranged facing each other and lying on two parallel and substantially horizontal planes, and vice versa, said doors being movable through a synchronized rotary-translating motion operated in the same direction when passing from said closing position to said opening position, and vice versa, wherein said mechanism comprises a first and a second kinematic device respectively adapted to move said first door and said second door, said first and second kinematic devices being separate and distinct, and wherein said assembly further comprises a mechanism for synchronizing the rotary-translating motion of the doors and changing a ratio of transmission of the rotary-translating motion of the doors, thereby imparting differential trajectories to the synchronized motion of said first door with respect to said second door in the rotary-translating motion between said closing position to said opening position and vice versa, kinematically connecting said first and said second kinematic device;

wherein said first and second kinematic devices each comprise pairs of elements symetricall arranged adjacent opposite sides of said first and second doors said elements comprising respectively, on each side, a first and second transmission mechanism;

a first and a second sliding member slidingly movable within a guide groove to pass from said closing position to said opening position, and vice versa, said guide groove being associable to a vertical side of a compartment closable with said first and second doors, said first and second doors being rotatably mounted on the respective sliding member, around a first and a second pin, respectively;

a first plurality of transmission elements and a second plurality of transmission elements;

a first and a second counterbalancing mechanism; and a first arm rotatably associable to said second side and to said first door at the respective ends, and a second arm rotatably associable to said second side and to said second door at the respective ends.

2. The assembly for opening and closing doors according to claim 1, wherein said first and said second transmission mechanisms respectively comprise a first and a second toothed belt attachable at one end to a top wall, and associated at the opposite end respectively to said first and said second counterbalancing mechanisms, each formed by a solid body, said first and said second toothed belts being adapted to engage respectively said first plurality of transmission elements and said second plurality of transmission elements.

3. The assembly for opening and closing doors according to claim 2, wherein said first solid body has a mass at least equal to a quarter of the mass of said first wing, and is arranged to act as a counterweight for said first door, and said second solid body has a mass at least equal to a quarter of the mass of said second wing and is arranged to act as a counterweight for said second wing.

4. The assembly for opening and closing doors according to claim 2, wherein the distance covered by said first and said second solid bodies passing from said closing position to said opening position is substantially equal respectively to twice the distance covered by said first sliding member passing from said closing position to said opening position, and twice the distance covered by said second sliding member passing from said closing position to said opening position.

5. The assembly for opening and closing doors according to claim 1, wherein said first plurality of transmission elements of said first kinematic arrangement and said second plurality of transmission elements of said second kinematic arrangement respectively include:

a first and a second movable pulley, each integrally mounted on the respective sliding member, coaxially respectively to said first and said second pins, and a first and a second plurality of pulleys fixable to said side.

6. The assembly for opening and closing doors according to claim 5, wherein said mechanism for synchronizing the motion and changing the ratio of transmission comprises a transmission pulley mounted integral and coaxial to a pulley of said first plurality of fixable pulleys belonging to said first kinematic device, and a third transmission mechanism formed by a third closed loop toothed belt adapted to be engaged both with a drive pulley and with a pulley of said second plurality of fixable pulleys belonging to said second kinematic device to operate the kinematic connection between said first and said second kinematic devices.

7. The assembly for opening and closing doors according to claim 6, wherein the ratio between the diameters of said transmission pulley and a pulley on which said transmission pulley is mounted is substantially equal to the ratio between the distance covered by the second sliding member, associated to said second door, passing from said closing position to said opening position and the distance covered by the first sliding member, associated to said first door, passing from said closing position to said opening position.

8. The assembly for opening and closing doors according to claim 6, wherein a fourth transmission mechanism, comprising a transmission shaft, is provided between at least one transmission element fixable to said side and the corresponding transmission element provided on an opposite side.

9. The assembly for opening and closing doors according to claim 8, further comprising a powered actuator mechanism connected to said transmission shaft to operate the motion of said first and said second kinematic arrangements.

10. A piece of furniture comprising at least two parallel vertical sides and a top defining a compartment closable with an assembly for opening and closing doors according to claim 1.

11. A piece of furniture according to claim 10, wherein said first and said second kinematic arrangements each comprise pairs of elements symmetrically arranged on said sides, said elements comprising respectively, on each side, first and second transmission mechanisms, first and second sliding members slidingly movable within a guide groove to pass from said closing position to said opening position, and vice versa, said guide groove being associated to said side, said first and second wings being rotatably mounted on the respective sliding member, around first and second pins, respectively;

a first plurality of transmission elements and a second plurality of transmission elements;

first and second counterbalancing mechanisms;

first and second arms rotatably associated with one end to said side respectively around first and second fulcrums, and connected with the opposite end to the sides respectively of said first and second wings such that, in the opening position, said first and second wings are at least partially housed within said compartment, adjacent said top.

* * * * *